US006148789A

United States Patent [19]

Johns

[11] Patent Number: 6,148,789

[45] Date of Patent: Nov. 21, 2000

[54] ENGINE-PRESSURIZED PRESTART OILER

[76] Inventor: Ralph Howard Johns, 153 Paseo Delicias, Redondo Beach, Calif. 90277

[21] Appl. No.: 09/243,906

[22] Filed: Feb. 3, 1999

[51] Int. Cl.[7] ..... F01M 5/00

[52] U.S. Cl. ..... 123/196 S; 123/196 R; 184/6.3; 184/6.5

[58] Field of Search ..... 123/196 S; 184/6.3, 184/6.5

[56] References Cited

U.S. PATENT DOCUMENTS

| | | | |
|---|---|---|---|
| 1,446,505 | 2/1923 | Hubbard | 123/196 S |
| 2,033,992 | 3/1936 | Moller . | |
| 2,273,888 | 2/1942 | Paulsen . | |
| 2,747,564 | 5/1956 | Wehling . | |
| 2,755,787 | 7/1956 | Butler . | |
| 3,583,525 | 6/1971 | Holcomb . | |
| 4,061,204 | 12/1977 | Kautz, Jr. . | |
| 4,094,293 | 6/1978 | Evans . | |
| 4,359,140 | 11/1982 | Shreve . | |
| 5,014,820 | 5/1991 | Evans | 184/6.3 |
| 5,069,177 | 12/1991 | Dokonal . | |
| 5,147,014 | 9/1992 | Pederson | 184/6.3 |
| 5,156,120 | 10/1992 | Kent . | |
| 5,197,424 | 3/1993 | Blum . | |
| 5,488,935 | 2/1996 | Berry, Jr. . | |
| 5,494,013 | 2/1996 | Helbig . | |
| 5,655,495 | 8/1997 | Richards . | |
| 5,694,896 | 12/1997 | Melvin . | |
| 5,871,068 | 2/1999 | Selby | 123/196 S |

*Primary Examiner*—Erick Solis
*Assistant Examiner*—Brian Hairston

[57] ABSTRACT

An engine-pressurized prestart oiler for an engine having pressure lubrication is provided, which rapidly lubricates critical engine bearing surfaces prior to the starting sequence. An accumulator for storing oil and pressurized air contains an air-oil separation float, which essentially fills the internal cross-sectional area and prevents absorption of the air. Discharge and recharge of the accumulator is preferably implemented by a normally closed solenoid valve. Discharge is controlled either manually by a switch or automatically by circuitry containing ignition-off time and accumulator pressure comparators, a starter interrupter, and a prestart oiling timer. Recharge is automatic, as the solenoid valve allows oil flow whenever the engine oil pressure sufficiently exceeds the accumulator pressure. A conduit connects the accumulator, solenoid valve, and engine, connecting to the engine either at the oil pressure sensor port or through an adaptor installed between the oil filter and the oil filter mount.

10 Claims, 4 Drawing Sheets

ENGINE-PRESSURIZED PRESTART OILER

BACKGROUND

1. Field of Invention

The instant invention relates to an apparatus for prestart oiling of any pressure-lubricated machine that experiences frequent periods of rest between intervals of operation.

2. Description of Prior Art

During normal operation of an internal combustion engine, vital engine parts are supplied with oil by a pressure lubricating system. Oil is drawn from a sump by a pump driven by the running engine. The pump forces oil under pressure via galleries throughout the engine to vital bearing surfaces including the crankshaft, connecting rod, and cam bearings, and to the valve train.

Start-up of the engine inherently involves a period of inadequate lubrication. When an engine is shutdown after an interval of operation, oil drains from the lubricating system including, to varying degrees, the bearing surfaces, oil galleries, pump, filter, and possibly an oil cooler. Upon restarting, the engine cranks and then may run for several seconds before the lubricating system refills and oil is again supplied to the bearing surfaces. Higher operating temperatures at shutdown and longer intervals of rest increase the degree of drainage and the time required to reinstate proper lubrication.

It is well recognized that severe wear can occur during the repeated cold starts to which internal combustion engines are typically subjected. In addition to aggravated normal frictional wear as a result of inadequate lubrication, very harmful scoring of the bearing surfaces can occur. It is generally acknowledged that well over half of all bearing wear may occur as a result of cold starts.

Numerous prior art patents address this problem by the provision of a prestart oiling device. The majority of these employ an accumulator to store oil as well as the energy to deliver the oil to the engine. Prestart oiling is generally implemented by a solenoid valve, which is interposed in a conduit between the accumulator and the engine. The normally closed valve is opened shortly before or coincident with the starting sequence. Then during running operation, the accumulator is recharged from the engine's pressure lubricating system.

Several of the prior inventions utilize an accumulator in which air and oil are in direct contact. A problem with this type of accumulator is that the oil absorbs the pressurized air. Half, or even more, of the air can be absorbed within a few weeks. Thus, periodic maintenance to replenish the energy-storing air is a major disadvantage of this type of accumulator.

Other prior inventions incorporate various components to separate a portion of the accumulator as an air chamber without an oil interface. These components include flexible membranes and bladders, diaphragms with springs, and pistons with seals. Although these designs may overcome the air absorption problem, other disadvantages are inherent. Membranes, bladders, and diaphragms are subject to cracking and rupture. Piston designs tend to be costly to manufacture, and wear and leakage may dictate periodic maintenance.

Other disadvantages of prior inventions involve the means of controlling oil flow between engine and accumulator. Some designs comprise a single path conduit and a valve, installed in the conduit, energized to the open position while the engine's ignition is turned-on. Thus, the stored pressure in the accumulator tends to approximate the final operating oil pressure of the engine. As the operating pressure of a warm engine is much less than attained shortly after a cold start, much of the energy potentially available for prestart oiling is lost.

Some of the prior inventions use two separate paths: one with a solenoid valve to discharge oil from the accumulator, and one with a check valve to allow recharging of the accumulator. Among the disadvantages of this design is the increased potential for leaks due to additional connections in the conduit. Several prior inventions employ a valve design unique to the particular invention, and some are quite complex. Inexpensive, leakproof, reliable, durable, and proven solenoid valves are commercially available. Thus, use of a standard commercial valve offers important advantages.

OBJECTS OF INVENTION

It is an object of this invention to provide means, applicable to an internal combustion engine having a pressure lubricating system, to lubricate the bearing surfaces prior to starting the engine.

It is an object of this invention that the means for performing the prestart lubrication require minimal modification to the engine, be adaptable as an easily retrofit assembly, and not materially alter normal engine operation.

It is an object of this invention that the means comprise an accumulator capable of storing oil and pressurized air for extended periods and in sufficient quantities to quickly and thoroughly perform the prestart lubrication.

It is an object of this invention that the means comprise a single path accommodating the fluid flow in both directions between accumulator and engine.

It is an object of this invention that the means will perform the prestart lubrication, and prepare for subsequent use, with minimal inconvenience to the engine/vehicle operator.

It is an object of this invention that the means be simple, reliable, durable, and require minimal maintenance.

LIST OF REFERENCE NUMERALS

Figure 1:
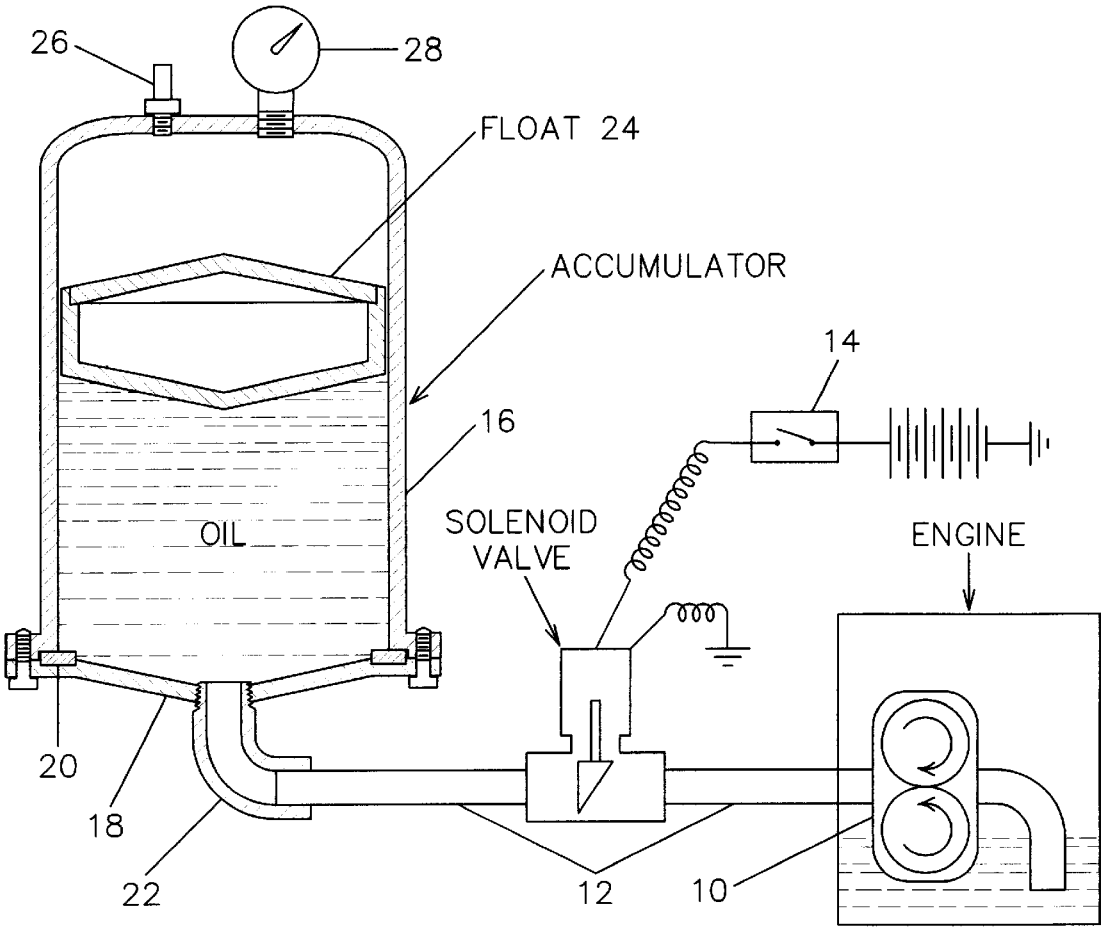
FIG. 1 is a diagrammatic overview of the invention with the accumulator shown in cross section.

| | |
|---|---|
| 10 | engine oil pump |
| 12 | conduit |

-continued

| LIST OF REFERENCE NUMERALS | |
|---|---|
| 14 | electrical switch |
| 16 | accumulator cylinder |
| 18 | accumulator end cap |
| 20 | accumulator seal |
| 22 | accumulator-to-conduit fitting |
| 24 | enclosed separation float |
| 26 | air valve |
| 28 | pressure gauge |
| 30 | partially covered separation float |
| 32 | open separation float |
| 34 | valve body |
| 36 | plunger |
| 38 | plunger tube |
| 40 | solenoid |
| 42 | solenoid nut |
| 44 | electrical leads |
| 46 | plunger seal |
| 48 | orifice seat |
| 50 | valve port to accumulator |
| 52 | valve port to engine |
| 54 | plunger spring |
| 56 | tee fitting |
| 58 | tee fitting ports to solenoid and engine |
| 60 | adaptor body |
| 62 | adaptor seal |
| 64 | adaptor stud |
| 66 | adaptor stud nut |
| 68 | adaptor stud axial bore |
| 70 | adaptor stud transverse bores |
| 72 | adaptor body axial bores |
| 74 | adaptor conduit attachment bore |
| 76 | alternate adaptor stud |
| 78 | adaptor check ball |
| 80 | adaptor spring |
| 82 | adaptor internal retainer ring |
| 84 | adaptor stud shoulder |
| 86 | check-orifice valve body |
| 88 | check-orifice valve poppet |
| 90 | check-orifice valve spring |
| 92 | check-orifice valve port to accumulator |
| 94 | check-orifice valve port to engine |
| 96 | check-orifice valve flow orifices |
| 98 | check-orifice valve limiter orifice |

DESCRIPTION OF PREFERRED EMBODIMENT

FIG. 1 provides an overview of the present invention, with the components drawn at various scales for clarity. In FIG. 1, an internal combustion engine or other machine having a pressure lubrication system is comprised of an oil pump 10 drawing oil from a sump. The oil pump delivers oil under pressure via galleries to various critical bearing surfaces. In the present invention, an oil conduit 12 connects the bottom of the accumulator to the engine pressure lubrication system. Means of attachment to the engine are detailed below in the discussion of FIGS. 5, 6 and 7. A solenoid valve, controlled by a normally open electrical switch 14, is interposed in the conduit and is detailed below in the discussion of FIG. 4.

FIG. 1, the accumulator for storing oil under pressure is comprised of a cylinder 16 with one formed, closed end. The other end is closed by an end cap 18 attached to the cylinder with a multiplicity of bolts. A seal 20 encircles the cylinder, end cap joint to prevent leakage. Although the formed end and the end cap are shown at the top and bottom, respectively, in FIG. 1, these locations could be reversed. Alternately, the accumulator can be comprised of an open cylinder and two end caps, the end cap can be attached to the cylinder by a threaded interface, or a self-sealing joint can supplant the cylinder, end cap seal. A fitting 22 connects the lower end of the accumulator to the conduit or directly to the solenoid valve. The accumulator total volume required for thorough prestart oiling depends on the engine size, but the range of 20 to 50 fluid ounces will cover most applications.

The accumulator is comprised of an air-oil separation float 24, which is buoyant in engine oil. The float essentially fills the cross-sectional area within the cylinder, but the clearance between the float and cylinder walls is sufficient to allow the float to buoyantly rise and fall with the oil level. The float in essence eliminates the oil, air interface and prevents the absorption of the pressurizing air. To permit proper operation of the float, the accumulator is mounted in an approximately vertical attitude, as indicated in FIG. 1, in any convenient manner and location.

An air valve 26 of typical pneumatic tire type is attached through the accumulator top wall in FIG. 1. The air valve is capable of maintaining pressure within the accumulator, and permits independent control of the operational air and oil relative volumes. Also shown in FIG. 1 is an optional accumulator pressure gauge 28 to monitor operational pressures. Alternately, a pressure sensor can be attached to the accumulator either for a remotely mounted gauge or for control of prestart oiling.

As noted above, the purpose of the accumulator float 24 is to essentially eliminate the air-oil interface and, thereby, prevent the absorption of the pressurizing air by the oil. Unlike means used in prior art to accomplish this task, the float is simple, reliable, durable, and requires minimal maintenance.

The general form of a suitable float depends on the prestart oiler application. If the oiler is installed on a stationary piece of equipment, the accumulator tilt may remain small. In this case, a float in the form of a thin disk can satisfy the air-oil separation task. However, in the more usual mobile installation as, for example, an automobile or boat, the float should maintain air-oil separation even with protracted, substantial accumulator tilt. Thus, the floats shown in FIGS. 1, 2 and 3 have cylindrical sidewalls with substantial height. Optimally, the float is designed such that, in oil, its buoyancy results in submersion to a depth about midway along its sidewall. It is noted that, for small accumulator-to-float gap, capillary attraction can cause oil to fill the gap, but this has no substantial effect on float operation.

Float 24 of FIG. 1 is an enclosed, sealed shell. Because it is sealed, it must be capable of withstanding exterior-to-interior pressure differentials. The float top and bottom could be flat. However, the conical shapes shown in FIG. 1 strengthen the float against pressure loads, as well as improving oil drainage from the top if the design tilt angle is exceeded. Float strength could also be enhanced with other end shapes, or by internal ribs. A benefit of the float 24 design is that it cannot flood.

Figure 2:
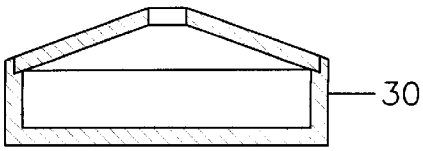
FIG. 2 is a partially covered variation of the accumulator separation float in cross section.
Figure 3:
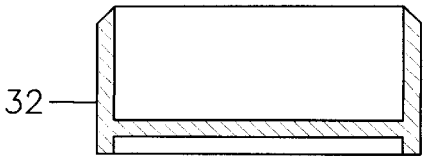
FIG. 3 is an open variation of the accumulator separation float in cross section.

Two variations of float design are shown in FIG. 2 and 3. Float 30 of FIG. 2 is generally similar to float 24 except for an air passage hole in the top, whereas float 32 of FIG. 3 is an open cup float. One benefit of floats 30 and 32 is their lack of pressure loads, and another is that their interiors contribute to the air volume available for expelling the oil from the accumulator. A further benefit of float 32 is that, of the three illustrated designs, it is the simplest to manufacture. Unlike float 24, floats 30 and 32 can suffer flooding by oil from excessive tilt. The conical top, shown for float 30, helps to prevent interior flooding at large tilt. Float 32 is shown with a sloped sidewall lip, which helps prevent oil that is skimmed off the accumulator wall during oiler operation from reaching the float interior. Also shown on float 32 is a sidewall lip extending below the bottom. The lip helps trap any air, which may be injected during accumulator refill, until it can be absorbed by the oil, thus maintaining a stable accumulator air quantity. In addition to these, numerous other variations in the float design are suitable.

Figure 4:
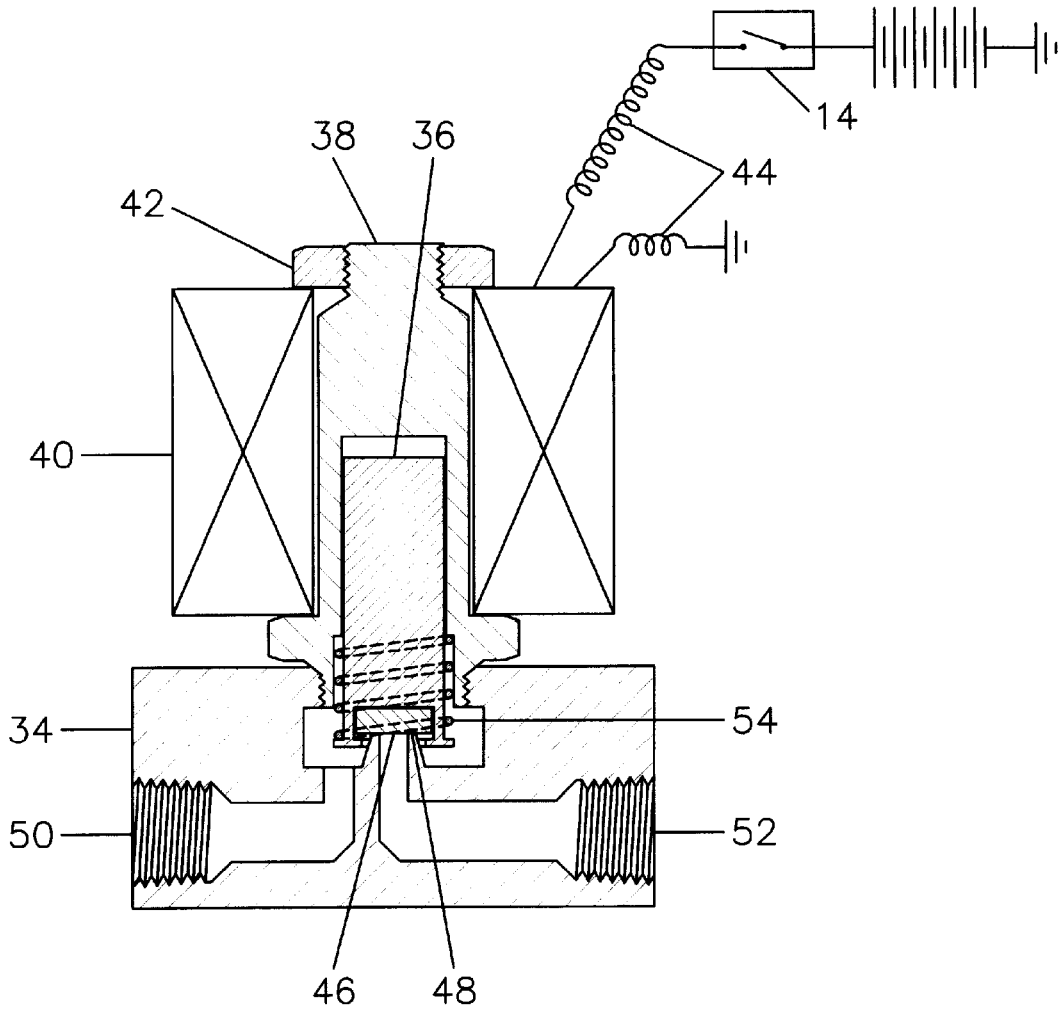
FIG. 4 is the solenoid valve in cross section.

FIG. 4 is a cross-sectional drawing of the solenoid valve. The solenoid valve is of a type commonly known as two-way, direct acting, normally closed. The object of a means comprising a single fluid path between the accumulator and engine can be achieved with any one of many stock or slightly modified commercially available solenoid valves. Hence, not all details of a solenoid valve of this type will be described. Only those aspects related to achieving the single fluid path object are discussed below.

The solenoid valve, FIG. 4, is comprised of the following major elements: valve body 34, plunger 36, plunger tube 38, and solenoid 40. The body of the plunger is made of a magnetic material. The solenoid is affixed to the valve by nut 42 in the drawing, although other attachment methods are obviously possible. The valve body, plunger tube joint can be sealed fittingly or with a gasket.

The solenoid has two electrical leads 44. One lead is grounded and the other passes through switch 14 to the engine's battery. In its most simple form, the switch is a mechanical, momentary-on type controlled directly by the engine/vehicle operator.

The position of the plunger controls flow through the valve. The plunger 36 comprises an elastomer plunger seal 46, which, in the closed valve position, seals against an orifice seat 48 in valve body 34. A port 50 in the valve leads to a passage surrounding the plunger 36 and a second port 52 leads to a passage encircled by orifice seat 48. The solenoid valve is oriented such that port 50 is toward the accumulator and port 52 is toward the engine. Also shown in FIG. 4 is an optional plunger spring 54 that assists valve closing.

In this prestart oiler application the solenoid valve must serve the same function as in usual applications; that is, the valve must be capable of opening against the plunger closing force resulting from the accumulator storage pressure acting at port 50. Valve opening is effected by energizing the solenoid, which creates an electromagnetic force on the plunger, causing the plunger and its seal to lift off the orifice seat. This allows flow in the direction from port 50 to port 52. Terminating the solenoid current closes the valve. Then the combined gravitational and, if so equipped, spring force returns the plunger and seal to the orifice seat. Aided by a forward pressure differential, essentially leakproof sealing is achieved.

In this prestart oiler application the solenoid valve must serve an important additional function. When the port 52, or engine, pressure exceeds the port 50, or accumulator, pressure, the valve must allow reverse flow to recharge the accumulator's oil supply. As the reverse pressure differential acts on the area encircled by the orifice seat, reverse flow begins when the pressure force overcomes the combined gravitational and spring force on the plunger.

In tests of the prestart oiler apparatus, all-around satisfactory performance has been obtained with several commercially available solenoid valves. If mounted in the upright attitude indicated in FIG. 4, some springless valves meet the performance requirements without modification. Most of the available valves comprise a plunger spring to assist closing, and these generally require slight modification. Some will operate satisfactorily with the plunger spring removed, while others require a relatively weak spring. In tests, satisfactory system performance has been obtained with valves that require a reverse pressure differential as low as 1 to 2 psi to initiate reverse flow. Internal combustion engines typically develop oil pressures of 50 psi or more following a cold start. Thus, the loss of stored accumulator pressure resulting from using a solenoid valve to meet the single fluid path object need not be very significant.

Modern internal combustion engines having a pressure lubricating system are fitted with either a gauge to indicate instantaneous pressure or a warning light to indicate when the pressure is below a preset value. In either case, a pressure sensor is normally mounted externally on the engine block to a port tapping into an oil gallery downstream of the pump and filter.

Figure 5:
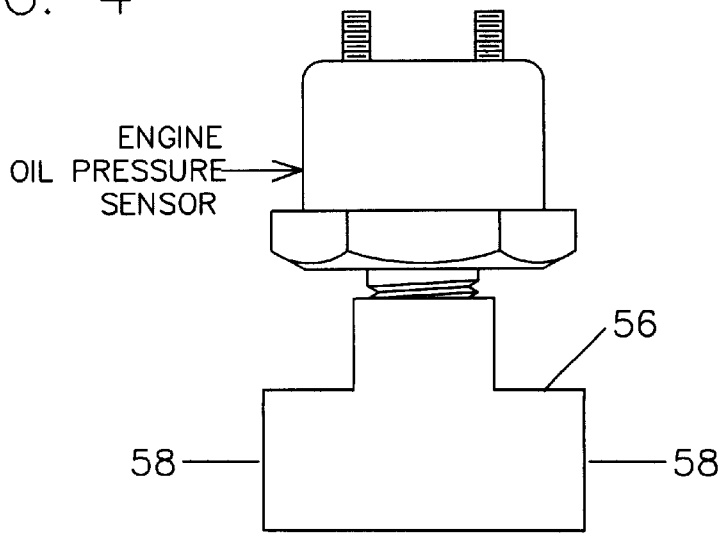
FIG. 5 is a side view of the tee fitting engine adaptor with engine oil pressure sensor attached.

The sensor attachment port provides a simple means to fluidly connect the prestart oiler to the engine. FIG. 5 illustrates a tee fitting 56 with the engine oil pressure sensor attached to one of its ports. Of its other two ports 58, one leads to the solenoid valve and the other to the normal sensor mount hole in the engine block. The tee fitting may be attached directly to the engine or solenoid valve, or installed at any location in the portion of conduit 12 between the engine and solenoid valve. Conduit 12 may, in fact, be attached to the tee fitting similarly installed on any accessible engine pressurized oil conduit, or attached directly to any available unused pressurized oil port.

OPERATION OF THE INVENTION

The preferred embodiment is designed to give the engine/vehicle operator maximum control of the prestart oiling function. Normally, if the engine has cooled to near ambient since its last use, prestart oiling would be performed. If the engine is still hot, the bearings will retain adequate lubrication and the operator may choose to bypass prestart oiler operation.

If prestart oiling is selected, the operator closes switch 14, which opens the solenoid valve, prior to activating the engine starter. The stored, pressurized air in the accumulator forces the float 24 down, pushing the oil from the accumulator through conduit 12 and into the engine oil galleries.

The prestart oiling will typically require from 5 to 20 sec to fill the oil galleries and thoroughly lubricate the bearing surfaces. Both the oil pump and filter restrict flow, with the result that relatively little oil flows in this direction within the engine. The air initially in the galleries is quickly expelled through the bearings and valve train, after which the oil flow rate from the accumulator markedly slows.

Various methods are available to the engine/vehicle operator to determine when to terminate prestart oiling. One indicator of the state of engine lubrication is the engine oil pressure gauge or warning light. Another indicator, if the accumulator is equipped with a pressure gauge, is a marked slowing of the accumulator pressure decrease when full lubrication is reached. However, after gaining some experience in using a particular installation, the operator may terminate prestart oiling after a predetermined time interval. Prestart oiling is terminated by opening switch 14, which allows plunger 36 to return to the closed valve position. The engine is then started in the normal manner.

Recharging of the accumulator is fully automatic. As described above, when the engine pressure exceeds the accumulator pressure by a differential sufficient to lift the solenoid valve plunger 36, oil flows from the engine to the accumulator. The recharging of the accumulator with oil raises the float 24 and repressurizes the air above the float. When the engine-to-accumulator pressure differential becomes insufficient to sustain the raised position of the plunger, the valve closes and flow terminates.

In the recharge process, the accumulator maintains the highest pressure reached. The opening, closing sequence of the valve may repeat several times as engine pressure fluctuates with engine speed. However, after several minutes of operation, the rising engine temperature will cause a general decrease in engine pressure. The solenoid valve will then remain closed until activated by switch 14. The accumulator maintains the highest pressure reached during recharging because the solenoid valve is closed whenever engine pressure is less than accumulator pressure.

The initial charging of the accumulator after installation is generally similar to the normal recharging process described above. When the engine is started after installation of the prestart oiler apparatus, engine pressure forces oil through the valve into the accumulator, raising the float and pressurizing the air above.

An optional variation in the initial charging is that the accumulator may be pressurized through the air valve 26 prior to starting the engine. This allows the quantity of air stored in the accumulator to be increased. For example, if the gauge pressure is raised to 15 psi before charging, the quantity of air stored for powering prestart oiling will be doubled. The result is that prestart oiling will require a shorter interval. Loss of pressurizing air, in the event that the float reaches the bottom of the accumulator during prestart oiling, can be prevented by the sealing of the float against seal 20, fitting 22, or a seal affixed at an intermediate diametric location.

DESCRIPTION AND OPERATION OF OTHER EMBODIMENTS

Figure 6:
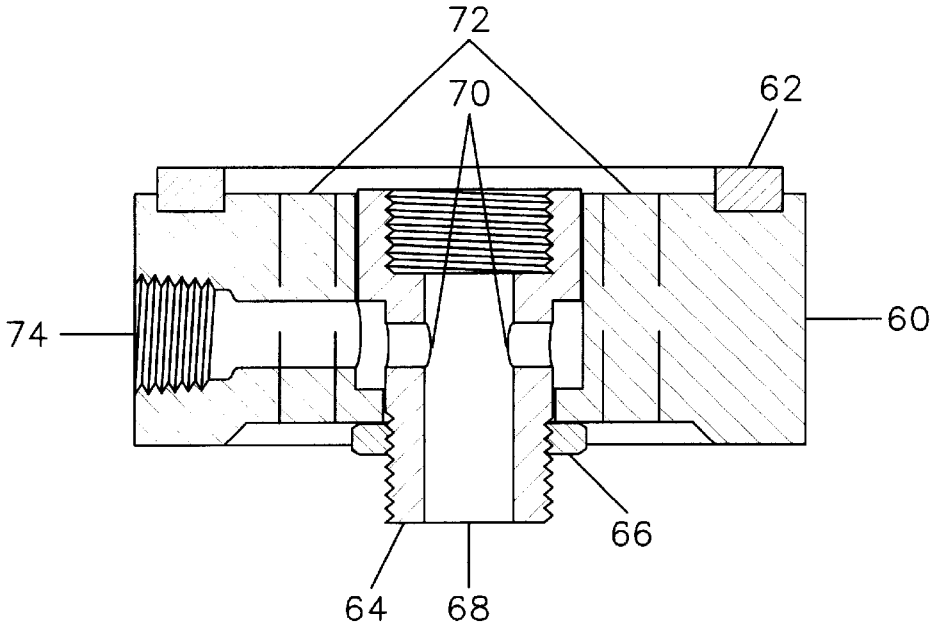
FIG. 6 is an alternate engine adaptor, fitting between engine block and oil filter, in cross section.

FIG. 6 is a cross-sectional drawing of an alternate means for adapting the prestart oiler apparatus to the engine. The FIG. 6 adaptor, which may be used instead of tee fitting 56, is interposed between the engine oil filter mount and the filter. The adaptor is comprised of an adaptor body 60, seal 62, stud 64, and stud nut 66. The internal and external threads of the stud accommodate the engine filter mount threads and the filter threads, respectively.

Various fluid passages are required to accommodate the present application. A bore 68 spans the length of the adaptor stud 64. Transverse bores 70 in stud 64 communicate with bore 68. Bores 72 span the adaptor body 60 in the axial direction. A single transverse bore 74 extends from the center to the periphery of adaptor body 60, with the outer end threaded for attachment of the accumulator-to-engine conduit 12.

The adaptor is installed by first removing the engine oil filter. The adaptor stud 64 is then firmly attached by its internal threaded portion to the engine filter mount. Next the adaptor body 60, with seal 62 in place, is slid over stud 64 and firmly attached with stud nut 66 while conveniently positioning adaptor conduit attachment bore 74. The prestart oiler conduit 12 is attached to the threaded portion of bore 74. The engine oil filter is mounted by means of the external threads of stud 64.

The use of the oil filter adaptor of FIG. 6 does not materially affect engine operation. When the engine is running, oil from the pump enters a disklike cavity between the engine filter mount and the adaptor body, and flows through adaptor bores 72 into a similar cavity between the adaptor body and the filter. The oil flows through the filter in the normal manner, through adaptor stud bore 68, and then through the output gallery of the engine filter mount.

The only change of prestart oiler operation resulting from use of the oil filter adaptor is in the flow path. When oil is expelled from the accumulator, it enters adaptor bore 74 from conduit 12 and flows into the cylindrical cavity formed between adaptor body 60 and adaptor stud 64. The oil then flows through stud bores 70 into stud bore 68. Because of the restrictive effect of the oil filter and pump, the majority of the oil flows from bore 68 into the filter mount output gallery and to the bearing surfaces. During recharge of the accumulator, oil flows in the reverse direction from stud bore 68 to conduit 12.

Figure 7:
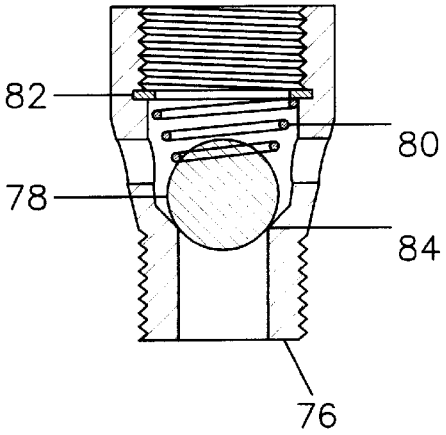
FIG. 7 is an alternate mounting stud for the FIG. 6 adaptor in cross section.

It has been noted above that, during prestart oiler discharge to the engine, a portion of the oil flows through the filter and pump to the sump. The alternate embodiment of the adaptor stud in FIG. 7 will prevent all flow to the sump. The alternate stud differs from stud 64 as necessary to incorporate a ball check valve. The stud 76 of FIG. 7 is seen to differ in contour from stud 64, and it additionally comprises a check ball 78, a conical spring 80, and an internal retainer ring 82. The spring is lightly compressed between the ball and retainer such that the ball seals against a shoulder 84 in the stud axial passage when the engine is off. Thus, during prestart oiler discharge, flow of oil is blocked from the filter and pump fluid path. During engine operation, the ball 78 unseats, with slight resultant pressure drop, allowing normal engine lubrication as well as recharging of the accumulator.

During the interval of accumulator recharge, there is some reduction in oil pressure supplying the engine bearings because a portion of the oil flow is diverted to the accumulator. As cold start oil pressures are relatively high, this reduction is not critical. However, an optional, modified check valve can minimize the reduction.

Figure 8:
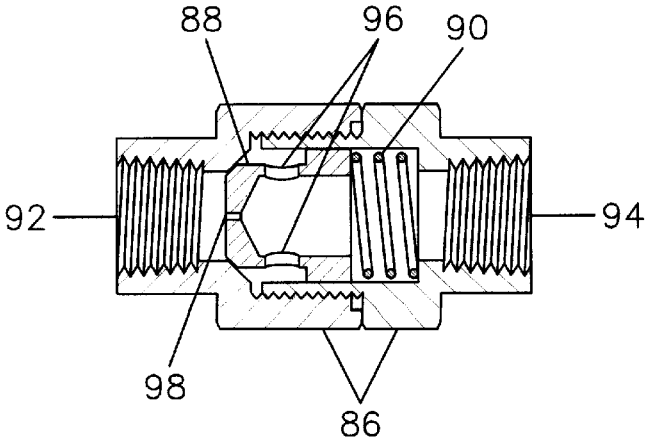
FIG. 8 is an optional check-orifice valve in cross section.

FIG. 8 illustrates a typical commercially available poppet-type check valve design, which is modified by an additional drilled orifice. The check-orifice valve is comprised of body halves 86, which mate sealingly, and a poppet 88, which moves axially against a light spring 90. The spring is retained by a shoulder in one body half, and the poppet seats against a shoulder in the other body half.

The check-orifice valve may be installed at any location in conduit 12, with valve port 92 toward the accumulator and port 94 toward the engine. During the prestart oiler discharge interval, the port 92 to port 94 pressure differential easily unseats the poppet and the oil flows freely around the poppet head, through flow orifices 96, and out through the poppet center bore. During accumulator recharge, with a positive pressure differential from port 94 to port 92, the poppet is seated. The oil then flows through the modified poppet via a drilled limiter orifice 98. Orifice 98 is sized to minimize engine oil pressure reduction while achieving accumulator full recharge before engine warm-up.

In the preferred embodiment, the operator-actuated switch 14 controls prestart oiling. An automated control may be desirable in some applications. There are many possibilities using system temperatures, pressures, and/or times.

Figure 9:
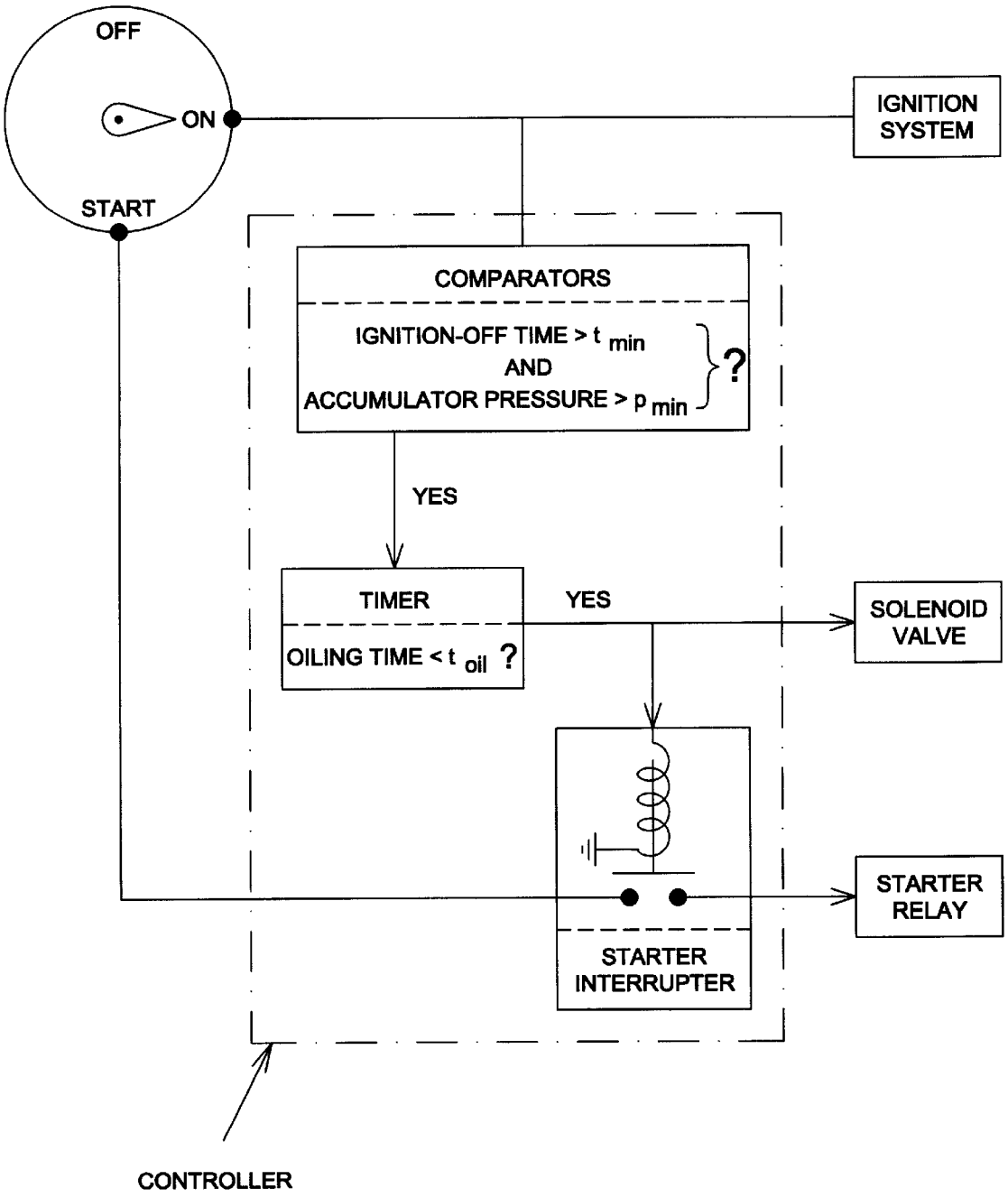
FIG. 9 is a schematic diagram of an alternate controller for the prestart oiler.

FIG. 9 is a schematic diagram of an alternate controller. This controller is comprised of ignition-off time and accumulator pressure comparators, a starter interrupter, and a prestart oiling timer. The ignition-off timer resets and begins timing whenever the ignition switch is returned to the off-position.

When the engine/vehicle operator turns the ignition switch to the on-position, the engine ignition system and the prestart oiler controller are activated. The controller checks whether the ignition-off time and the accumulator pressure are greater than their presets, denoted $t_{min}$ and $P_{min}$ in FIG. 9. If either is not true, the prestart oiling function is bypassed. As the starter interrupter is a normally closed switch, engine starting may proceed.

If the controller determines both checks to be true, prestart oiling is performed. The controller applies voltage to open both the starter interrupter and the prestart oiler solenoid valve. Thus, engine cranking is precluded while oiling is performed. When the elapsed time of oiling reaches the preset, denoted $t_{oil}$ in FIG. 9, voltage to the starter interrupter and the solenoid valve is suspended. The prestart oiling ceases, the starter interrupter closes, and engine starting may proceed.

SUMMARY AND SCOPE

The foregoing objects are accomplished by the present invention, described in the preceding specification. The prestart oiler accumulator recharges automatically, and stores oil and pressurized air for extended periods without maintenance. Prestart oiling is performed simply, either under direct control of the engine/vehicle operator or by an automatic controller during the start-up sequence. The device requires minimal modification to the engine, is easily retrofit, permits normal engine operation, and accommodates discharge and recharge through a single fluid path. Further, the device is simple, reliable, and durable.

It is to be understood that, although described in conjunction with an internal combustion engine, the present invention is applicable with other machines comprising a pressure lubricating system.

While numerous specifics are illustrated and described herein, various omissions, modifications, and substitutions will be apparent. For example, the solenoid valve described above could be replaced by other types of valves, such as another type of solenoid valve or a mechanical valve. Rather than air, another gas, such as carbon dioxide, could be used in the accumulator. A major novel feature of the present invention is the use of an accumulator float to separate the air from the oil. Several variations of the float design have been discussed above. However, numerous other variations of the float, as well as other components, will be apparent to those skilled in the art without departing from the broader spirit and scope of the invention as set forth in the appended claims. Thus, the scope of this invention should be determined by the appended claims and their legal equivalents.

I claim:

1. In combination with an engine comprising a pump delivering oil via galleries to various bearing surfaces, an engine-pressurized prestart oiler comprising:

a) an accumulator formed by a cylinder with closed ends, said accumulator mounted in an approximately vertical attitude, b) a float, buoyant in said oil, essentially filling the cross-sectional area internal to said accumulator, with sufficient clearance between said float and the cylinder walls to allow axial movement under the influence of the buoyancy force, c) a conduit fluidly connecting a port through the bottom of said accumulator and the engine oil galleries, and d) valve means, interposed within said conduit, for controlling fluid flow between said accumulator and said engine oil galleries, whereby said float effectively separates oil from pressurizing air in said accumulator and thereby minimizes absorption of said air by said oil.

2. The device of claim 1, further including a normally closed air valve fitted to top of said accumulator.

3. The device of claim 1, further including pressure sensing means fitted to said accumulator.

4. The device of claim 1, further including a check-orifice valve, interposed in said conduit, comprising a check valve modified with a bypass orifice, sized to limit oil flow rate, whereby said check-orifice valve allows free flow during discharge of said accumulator and restricted flow during recharge.

5. The device of claim 1, wherein said valve means is a normally closed solenoid valve comprising:

a) a solenoid with electrical control means, b) a plunger tube sealed to a valve body, c) a plunger of magnetic material movable within said plunger tube, d) a fluid flow path within said valve body, terminating with ports for connecting said conduit to said engine and to said accumulator, and e) an orifice seat interposed within said flow path on which said plunger rests to close said path, with opening of said flow path effected by either of the two following forces urging said plunger away from said orifice seat:

f) an electromagnetic force on said plunger when said solenoid is energized, or g) a pressure differential force on said plunger when the fluid pressure at the engine port exceeds that at the accumulator port, whereby said solenoid valve provides automatic recharging of said accumulator with a single path accommodating fluid flow in both directions between said accumulator and said engine.

6. In combination with an engine comprising a pump delivering oil via galleries to various bearing surfaces, and an attachment port for an engine oil pressure sensor fluidly connecting to said galleries, the device of claim 1, wherein said conduit is connected to said attachment port, further including a tee fitting interposed within said conduit between said valve means and said engine with said engine oil pressure sensor connected to the remaining leg of said tee fitting.

7. In combination with an engine comprising a pump delivering oil via galleries to various bearing surfaces, and a filter mount for attachment of an engine oil filter, the device of claim 1, further including an oil filter adaptor comprising:

a) an adaptor body mating to said filter mount with intermediate sealing means, b) an adaptor stud, passing through a longitudinal hole of said adaptor body, with one end threaded for attachment to threads of said filter mount, and the other end threaded for an adaptor stud nut, fixing said adaptor body to said filter mount, and for attachment of said filter, c) one or more axial bores through said adaptor body, allowing flow from an input gallery of said filter mount into said filter, d) an axial bore through said adaptor stud, allowing flow from said filter into an output gallery of said filter mount, e) a transverse bore in said adaptor body from said longitudinal hole to a periphery location threaded thereat for attachment of said conduit, allowing communication between said conduit and an annular cavity between said adaptor body and said adaptor stud, and f) one or more transverse bores through said adaptor stud, allowing communication between said annular cavity and said axial bore through said adaptor stud, whereby said adaptor body can be rotationally positioned for convenient attachment of said conduit.

8. The device of claim 7, further including a ball check valve within said axial bore through said adaptor stud, comprising: a ball, a narrow region, in said axial bore leading to said filter, forming a seat for said ball, and a conical compression spring urging said ball toward said seat, with means for retaining an end of said spring distant from said ball, whereby said ball check valve precludes flow through said filter during prestart oiling.

9. In combination with an engine comprising a pump delivering oil via galleries to various bearing surfaces, and a starter relay circuit controlled by an ignition switch with off, on, and start positions, the device of claim 5, wherein said electrical control means for said solenoid is a mechanical, momentary-on switch.

10. In combination with an engine comprising a pump delivering oil via galleries to various bearing surfaces, and a starter relay circuit controlled by an ignition switch with off, on, and start positions, the device of claim 5, wherein said electrical control means for said solenoid is an automatic controller comprising:

a) ignition-off time and accumulator pressure comparators, activating when said ignition switch is turned from said off- to on-positions, b) a normally closed starter interrupter, which opens said starter relay circuit if both said ignition-off time and said accumulator pressure exceed respective preset values, and c) a prestart oiling timer, which activates said solenoid valve and begins timing upon the opening of said starter interrupter, and terminates prestart oiling and starter interruption when said prestart oiling timer reaches a preset value, whereby fully automatic control of prestart oiling and starter interruption are achieved.

* * * * *